US006908297B2

(12) United States Patent
Dafft et al.

(10) Patent No.: US 6,908,297 B2
(45) Date of Patent: Jun. 21, 2005

(54) HYDROGEN-FUELED FLARE SYSTEM

(75) Inventors: Charles Anthony Dafft, Friendwood, TX (US); Michael Stanley DeCourcy, Houston, TX (US)

(73) Assignee: Rohm and Haas Company, Philadelphia, PA (US)

( * ) Notice: Subject to any disclaimer, the term of this patent is extended or adjusted under 35 U.S.C. 154(b) by 49 days.

(21) Appl. No.: 09/847,127

(22) Filed: May 2, 2001

(65) Prior Publication Data

US 2003/0190569 A1 Oct. 9, 2003

Related U.S. Application Data

(60) Provisional application No. 60/207,749, filed on May 26, 2000.

(51) Int. Cl.[7] ..... F23G 7/08
(52) U.S. Cl. ..... 431/4; 431/5; 431/202
(58) Field of Search ..... 431/5, 202, 4

(56) References Cited

U.S. PATENT DOCUMENTS

| | | | | | |
|---|---|---|---|---|---|
| 3,071,453 | A | * | 1/1963 | James | 48/198.7 |
| 3,813,229 | A | * | 5/1974 | Pagani | 48/198.1 |
| 3,873,671 | A | * | 3/1975 | Reed et al. | |
| 3,911,083 | A | * | 10/1975 | Reed et al. | |
| 3,976,034 | A | * | 8/1976 | Shinohara et al. | 123/1 A |
| 4,117,075 | A | * | 9/1978 | Sano | |
| 4,147,495 | A | * | 4/1979 | Straitz, III | |
| 4,519,993 | A | * | 5/1985 | McGill et al. | 423/235 |
| 5,061,463 | A | * | 10/1991 | Vickery | 423/210 |
| 5,366,699 | A | * | 11/1994 | Milfeld et al. | 422/169 |
| 5,937,632 | A | * | 8/1999 | Dobbeling et al. | 60/777 |
| 6,494,711 | B1 | * | 12/2002 | Takemura et al. | 431/353 |

FOREIGN PATENT DOCUMENTS

| | | | | |
|---|---|---|---|---|
| DE | 3326999 | * | 2/1984 | 431/202 |
| FR | 2 468 071 | * | 5/1981 | |
| GB | 1 213 848 | | 11/1970 | |
| GB | 1 278 577 | | 6/1972 | |
| JP | 51087469 | * | 7/1976 | 431/4 |
| JP | 53-44048 | * | 11/1978 | 431/4 |
| JP | 03051611 | * | 3/1991 | |
| WO | WO 93/19006 | * | 9/1993 | 431/4 |

OTHER PUBLICATIONS

"Basis and Purpose Document on Specifications For Hydrogen–Fueled Flares" U.S. Environmental Protection Agency, Office of Air Radiation, Office of Air Quality Planning Standards, Research Triangle Park, North Carolina 27711 (Mar. 1998).

* cited by examiner

*Primary Examiner*—Carl D. Price
(74) *Attorney, Agent, or Firm*—Marcella M. Bodner

(57) ABSTRACT

A process is provided for thoroughly destroying dilute gaseous waste materials produced in an industrial manufacturing process by blending the same with a hydrogen-containing enrichment fuel stream. The resulting blend includes a sufficient amount of hydrogen such that at least 80% of the dilute gaseous waste material is converted to carbon dioxide and water vapor upon combustion at a flare.

10 Claims, 1 Drawing Sheet

HYDROGEN-FUELED FLARE SYSTEM

CROSS REFERENCE TO RELATED PATENT APPLICATIONS

This is a non-provisional application of prior pending U.S. provisional application Ser. No. 60/207,749 filed May 26, 2000.

This invention relates to processes for burning gaseous waste materials using a flare. More particularly, it pertains to processes wherein the gaseous waste materials have a relatively low combustion level and need to be blended with an enrichment fuel having a relatively higher combustion level in order to achieve and maintain their thorough destruction.

Many industrial manufacturing processes generate substantial quantities of gaseous waste materials. It is important for safety, health and environmental reasons that these waste materials be safely and effectively disposed.

One frequently used method for disposing of such waste materials is to burn them in what is known as a "flare". The term "flare" as used herein includes all types of flares known to those skilled in the art such as ground flares, flare stacks, and the like.

Some gaseous wastes are flammable to the extent that they can ensure their thorough destruction by their mere combustion. As used herein, the term "thorough destruction" refers to conversion of at least about 80% of a gaseous waste material to carbon dioxide and water vapor, preferably at least about 90%, more preferably at least 95%, and even more preferably at least about 98%.

However, many gaseous wastes are non-flammable to extent that they would ensure their thorough destruction. Hereinafter, such insufficiently flammable gaseous wastes will be referred to as "dilute gaseous wastes". In a typical procedure used by the industrial manufacturing industry to thoroughly destroy such dilute gaseous waste, a highly combustible hydrocarbon fuel (e.g., methane, propane, oxygenated hydrocarbons such as methanol and the like) is often used as an enrichment fuel.

It is an important feature of a properly designed flare system that this at least about 80% destruction efficiency be maintained at all times in order to limit the quantity of hydrocarbon and other emissions that result from improperly burned wastes. It is also essential that the combustion be self-sustaining—that is, that the fuel/air/waste mixture contains sufficient energy to ensure that the flame will not be extinguished while waste is being fed to the flare. To meet these requirements, the U.S. Environmental Protection Agency (EPA) regulations require that the mixture fed to a non-assisted flare have a minimum net heating value of at least 200 British Thermal Units per standard cubic foot of waste (Btu/scf).

There are many inherent problems associated with conventional flare systems that rely on the use of an external supply of hydrocarbon enrichment fuel in order to ensure the thorough destruction of dilute gaseous wastes. One such inherent problem is the cost of employing an otherwise useable, highly combustible hydrocarbon fuel (e.g., methane, propane, oxygenated hydrocarbons such as methanol and the like) to burn waste. Another inherent problem of such systems is that the combustion of hydrocarbon fuels itself generates undesirable emissions of carbon dioxide and/or carbon soot. In addition, environmental regulations presume that the combustion of such fuels generates undesirable sulfur dioxide emissions, even if the hydrocarbon fuel actually contains no sulfur. However, notwithstanding the cost and inherent disadvantages associated with their operation, the industrial manufacturing industry continues to use hydrocarbon-enriched flares as a means of thoroughly destroying dilute gaseous wastes.

In view of the above, the industrial manufacturing industry would greatly welcome a means for thoroughly destroying dilute gaseous wastes while minimizing, if not completely eliminating, the need to enrich the waste stream with a hydrocarbon fuel. Such a process would not only significantly reduce operating costs, but also reduce the plant's emission generation.

Accordingly, one object of the present invention is to provide a method of significantly reducing the emissions from flare systems designed to thoroughly destroy dilute gaseous wastes.

Another object of the present invention is to provide a method of thoroughly destroying dilute gaseous wastes which utilizes a reduced amount of enrichment with a hydrocarbon fuel.

Still another object of the present invention is to provide a method of thoroughly destroying dilute gaseous wastes which utilizes essentially no amount of enrichment with a hydrocarbon fuel.

These and other objects are achieved by reducing the amount of hydrocarbon fuel used as the enrichment fuel and substituting therefor an amount of a hydrogen-containing gas stream as an enrichment fuel. Specifically, in the process of the present invention, a dilute gaseous waste stream is blended with a hydrogen-containing gas stream to form a blend which is subsequently sent to a flare for combustion. The amount of the hydrogen-containing gas stream present in the blend is such that the total hydrogen content of the blend is at least about 3 mole percent.

These and other objects and advantages of the invention will become apparent upon reading the following detailed description and upon reference to the drawings in which.

Figure 1:
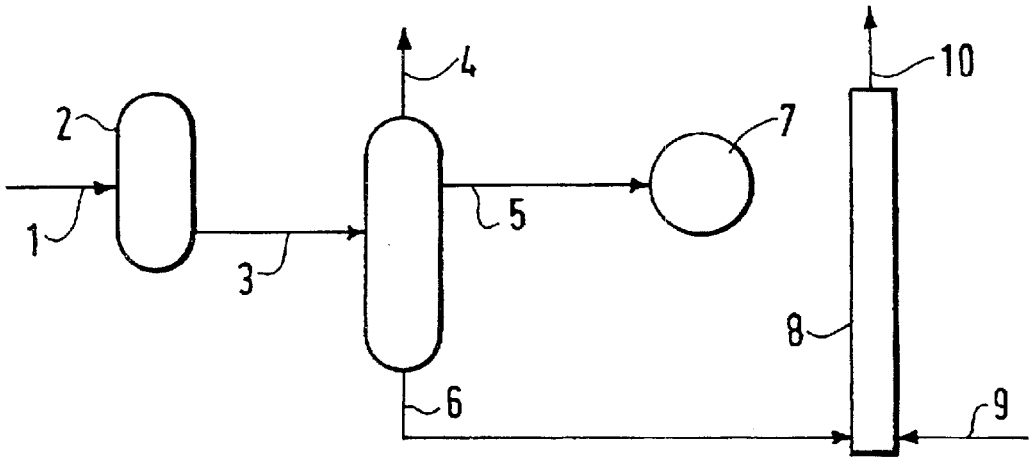
FIG. 1 depicts a simplified process flow diagram of a process that does not employ the present invention.

While the invention is susceptible to various modifications and alternative forms, specific embodiments thereof have been shown by way of example in the drawings and are herein described in detail. Those skilled in the art will appreciate, however, that these Figures are schematic only and that they omit process details that are not particularly relevant to the present invention. It should be further understood that the description herein of specific embodiments is not intended to limit the invention to the particular forms disclosed; but on the contrary, the intention is to cover all modifications, equivalents, and alternatives falling within the spirit and scope of the invention as defined by the appended claims.

Illustrative embodiments of the invention are described below. In the interest of clarity, not all features of an actual implementation are described in this specification. It will of course be appreciated by those skilled in the art that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As stated above, flares designed to thoroughly destroy dilute gaseous wastes have been typically enriched with hydrocarbon fuel to increase the Btu/scf value of the resulting blend in order to ensure that the waste is thoroughly destroyed. Dilute gaseous waste streams typically include a relatively high concentration of non-flammable materials such as air, water vapor, and/or inert materials (e.g., nitrogen). In fact, some dilute gaseous wastes are essentially totally comprised of non-flammable materials.

Dilute gaseous waste streams can be found in a number of different industrial manufacturing industries. The present invention can be employed in any of these industries. Some specific examples of industrial manufacturing industries where the present invention can be employed include, without limitation, the chemical manufacturing industry, the refining industry, the steel industry, and the like.

For instance, in the chemical manufacturing industry, dilute gaseous waste streams which contain relatively high concentration of air may include the effluent from suction vent gas systems, such as emissions abatement equipment provided for the sampling, transportation and storage of acrylic and methacrylic acid and their esters. Moreover, dilute gaseous waste streams which contain relatively high concentration of water vapor may include overhead vapor streams from wastewater stripping columns and other effluent streams from wastewater purification equipment. Also, dilute gaseous waste streams which contain relatively high concentration of inert gases may include the effluent from a purged vent gas collection header for a chemical process, such as a vent collection system for reaction and purification equipment used in the production of acetone cyanohydrin.

In the present invention, the dilute gaseous waste stream is enriched with a hydrogen-containing gas stream prior to being burned. Unlike conventional hydrocarbon-containing enrichment fuels which, when burned, produce carbon dioxide and soot, when hydrogen is burned it merely produces water vapor.

Hydrogen has a significantly lower net heating value than many of the hydrocarbon fuels heretofore used to enrich dilute gaseous waste streams being sent to flares. For example, the net heating value of methane, a typical hydrocarbon enrichment fuel, is about 913 Btu/scf. On the other hand, the net heating value of hydrogen is only about 275 Btu/scf. In view of this disparity, one would not expect that a gaseous mixture containing a relatively low concentration of hydrogen would be sufficient to thoroughly destroy the dilute gaseous waste with which it was blended.

However, to the contrary, it was surprising to discover that blending a hydrogen-containing gas stream with a dilute gaseous waste such that the hydrogen concentration of the resulting blend was at least about 3 mole percent will thoroughly destroy the dilute gaseous waste. The actual mole percent of hydrogen in the resulting blend depends, in part, on the emission standards set by the particular governmental regulatory agency where the flare is being operated. Typically, however, the amount of hydrogen-containing enrichment fuel employed is such that the resulting blend comprises a hydrogen concentration of at least about 5 mole percent, more typically at least about 8 mole percent, and even more typically at least about 10 mole percent.

By producing a blend as in accordance with the present invention, the blend will have a heating value of at least about 5 Btu/scf when combusted. As stated above, the actual heating value of the resulting blend upon combustion depends, in part, on the emission standards set by the particular governmental regulatory agency where the flare is being operated. Typically, however, the heating value of the resulting blend upon combustion is at least about 10 Btu/scf, more typically at least about 20 Btu/scf, and even more typically at least about 30 Btu/scf Additionally, the blend will have a heating value of at most about 250 Btu/scf when combusted. Typically, however, the heating value of the resulting blend upon combustion is at most about 200 Btu/scf, more typically at most about 150 Btu/scf, and even more typically at most about 100 Btu/scf.

Many widely used industrial manufacturing processes normally produce gas streams that contain hydrogen. When practicing this invention, these hydrogen-containing gas streams can serve as a direct replacement for more expensive hydrocarbon-containing enrichment fuels conventionally used. Accordingly, by practicing this invention, the cost of operating the flare will be reduced since a hydrogen-containing enrichment fuel containing hydrogen is generally of less valuable than the volume of a hydrocarbon-containing enrichment fuel needed to achieve the same minimum heating value of the resulting blend. Therefore, in one embodiment of the present invention, the substitution of a low-grade hydrogen-containing enrichment fuel for a hydrocarbon enrichment fuel serves to increase the output of an associated reactor process wherein a hydrocarbon enrichment fuel such as methane is simultaneously used.

When practicing this invention, the amount of the hydrogen-containing enrichment fuel needed to thoroughly destroy the dilute gaseous waste material upon combustion also depends, in part, on the Btu/scf value of the dilute gaseous waste material and the hydrogen content of the hydrogen-containing enrichment fuel. However, after reading this specification, one of ordinary skill in the art will be able to calculate the appropriate concentrations to be employed.

The hydrogen-containing enrichment stream needs to contain a sufficient amount hydrogen such that, when blended with the dilute gaseous waste stream, the resulting blend has sufficient heating value to thoroughly destroy the dilute gaseous waste material upon combustion. Typically, the hydrogen-containing enrichment stream contains at least about 4 mole percent hydrogen gas; more typically at least about 8 mole percent of hydrogen gas; and even more typically at least about 12 mole percent of hydrogen gas. It is, however, within the scope of this invention for the hydrogen-containing enrichment stream to consist of between about 50 to about 100 mole percent of hydrogen gas, or between about 70 to about 100 mole percent, or even between about 90 to about 100 mole percent.

This invention can be practiced when the resulting flare blend contains from about 5 to about 99 weight percent of a dilute gaseous waste material. Typically, the resulting flare blend contains from about 10 to about 95 weight percent of a dilute gaseous waste material; and more typically from about 15 to about 90 weight percent of a dilute gaseous waste material.

Moreover, in the practice of the present invention, the resulting flare blend contains from about 95 to about 1 weight percent of a hydrogen-containing enrichment gas stream. Typically, the resulting flare blend contains from about 90 to about 5 weight percent of a hydrogen-containing enrichment gas stream; and more typically from about 85 to about 10 weight percent of a hydrogen-containing enrichment gas stream.

While the practice of the present invention is designed to reduce the amount of hydrocarbon-containing enrichment fuel needed to thoroughly destroy a dilute gaseous waste stream upon combustion, the resulting flare blend can optionally contain a hydrocarbon-containing enrichment fuel. On the other hand, it is within the scope of this invention for the resulting flare blend to contain essentially no hydrocarbons. As used herein, the term "essentially no hydrocarbons" means that there resulting flare blend contains less than 20 weight percent hydrocarbons; typically less than about 15 weight percent hydrocarbons; more typically less than about 10 weight percent hydrocarbons, and even more typically less than about 5 weight percent hydrocarbons.

However, if the resulting flare blend contains hydrocarbons, they are typically present in an amount from about 20 to about 70 weight percent; More typically, from about 25 to about 60 weight percent; and even more typically from about 30 to about 50 weight percent.

A typical chemical manufacturing process that would benefit greatly from the present invention is shown in FIG. 1. The process includes a reactor, a flare stack, and a boiler. Feed stream 1 is fed to reactor 2, wherein a chemical reaction produces a product stream 3 that may be separated downstream of the reactor into a refined product stream 4, a hydrogen-containing effluent stream 5, and a waste stream 6. Effluent stream 5 is fed to boiler 7, where it serves as fuel; waste stream 6 is burned in flare stack 8. To provide the necessary combustion efficiency, the feed to flare stack 8 is enriched with a fuel stream 9 having a high net heating value.

In some industrial manufacturing plants, low-grade fuel that contains a sufficiently high concentration of hydrogen is often used as a low-grade boiler fuel, and high-grade hydrocarbon fuel such as methane is used as an enrichment source of flares designed to thoroughly destroy dilute gaseous waste streams. However, by practicing this invention, the low-grade, hydrogen-containing gas stream is used as the enrichment source. Accordingly, this frees-up the hydrocarbon fuel for use in a system such as a boiler fuel. Since the hydrocarbon fuel has a significantly higher Btu/scf value than fuel that contains a sufficiently high concentration of hydrogen, significantly less of the hydrocarbon fuel is required to maintain the desired boiler temperature. Therefore, practicing the present invention is a heretofore unrealized efficient use of resources.

Figure 2:
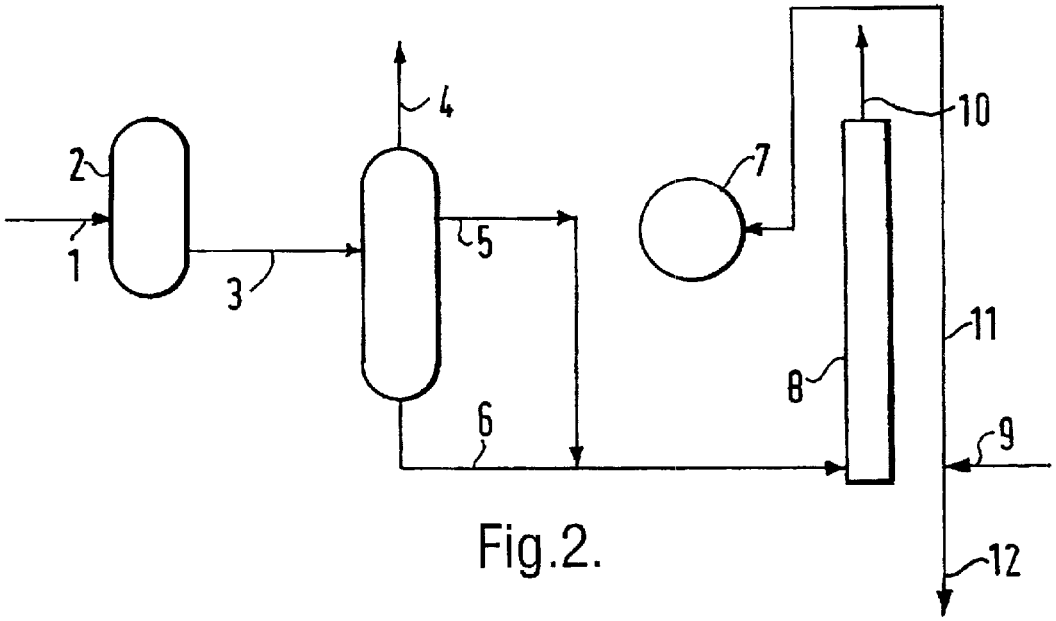
FIG. 2 depicts a simplified process flow diagram of a process that has been modified in accordance with the present invention.

FIG. 2 schematically depicts the rerouting of the process streams to achieve this result. Hydrogen-rich effluent stream 5 now fuels the flare stack, and fuel gas stream 9 splits to form stream 11, which fuels the boiler, and stream 12, which is available for use elsewhere. Of course, it would also be possible to realize the benefits of this invention by eliminating stream 12 entirely and reducing the flow rate of stream 9 such that no excess fuel is provided. The reduced fuel consumption translates directly into a reduced process operating cost.

Reconfiguration of the process in accordance with the present invention provides the additional benefit that the flare emission stream 10 contains significantly less carbon, both in the form of soot and as carbon oxides, because the fuel gas contains less carbon. Moreover, although it may not be immediately apparent, other undesirable emissions are also reduced.

One detrimental effect of a flare operation is the formation of nitrogen oxides from air at the flare tip, where the temperature is extremely high. Because the combustion of hydrogen produces significantly lower Btu/scf when compared to the Btu/scf production when a hydrocarbon such as methane is combusted, the reaction of nitrogen and oxygen at the tip of the hydrogen flare occurs more slowly. This results in the reduction of $NO_x$ emissions. In some cases, where the original flare fuel gas is natural gas or another fuel that contains small amounts of sulfur compounds, the substitution of a hydrogen-containing enrichment stream for all or part of the natural gas may also provide a reduction in $SO_2$ emissions of the flare.

An essential feature for operation of the process described herein is the availability of a supply of hydrogen or of an enrichment gas stream that contains a sufficient concentration of hydrogen to sustain combustion when it is mixed with a dilute gaseous waste stream. As stated above, many industrial manufacturing processes inherently produce hydrogen-containing process streams that can be used when practicing this invention. For example, the reactor effluent from an ammonia decomposition process may contain as much as eighteen weight percent hydrogen.

The present invention is applicable to most processes that generate hydrogen-containing streams and not only to the exemplary process described above. In particular, the invention is entirely applicable where the hydrogen-containing stream contains pure hydrogen or hydrogen mixed with significant amounts of other combustible or noncombustible materials. Examples of other typical process streams that generally contain sufficient hydrogen to sustain combustion, and thus could be used in the present invention, may include the following: unreacted synthesis gas (which typically contains CO and hydrogen) produced by partial oxidation of hydrocarbons; hydrogen/nitrogen mixtures produced by the dissociation of ammonia over an iron catalyst; tail gas from the production of acetylene, and the like.

Table 1 below depicts the significant reduction in the fuel requirements of the flare as well as the beneficial effect on emissions that may be achieved by implementation of the present invention. In each of the cases in the table, the overhead stream from a stripper column (a typical chemical process waste stream containing 86 weight percent water vapor, 7 weight percent nitrogen, 4 weight percent $NH_3$, and 3 weight percent HCN) is supplied to a flare stack at a rate of about 125 thousand standard cubic feet per hour (MSCFH). The waste stream is combusted using a conventional fuel and a number of alternative hydrogen-containing fuel streams that are within the scope of the present invention. As the Table illustrates, the substitution of hydrogen-containing streams for the conventional hydrocarbon-containing flare fuel provides considerable reduction in CO emissions, as well as reduced fuel consumption while still achieving the thorough destruction of dilute gaseous waste streams.

TABLE

Emissions Reduction Achieved Using Various Hydrogen Sources

| Case | Flare Fuel (compositions by weight) | CO (tons/yr) | $NO_x$ (tons/yr) | $SO_2$ (tons/yr) | Fuel Consumption (MSCFH) |
|---|---|---|---|---|---|
| Base | Natural gas ($CH_4$ with trace $H_2S$) | 68.524 | 20.711 | 0.021 | 26.4 |
| 1 | Hydrogen (100% $H_2$) | 5.088 | 12.089 | 0.000 | 10.9 |
| 2 | Dissociated ammonia (82% $N_2$ + 18% $H_2$) | 5.088 | 19.913 | 0.000 | 15.0 |

TABLE-continued

Emissions Reduction Achieved Using Various Hydrogen Sources

| Case | Flare Fuel (compositions by weight) | CO (tons/yr) | $NO_x$ (tons/yr) | $SO_2$ (tons/yr) | Fuel Consumption (MSCFH) |
|---|---|---|---|---|---|
| 3 | Acetylene tail gas (8% $CH_4$, 1% $C_2H_4$, 65% CO, 10% $H_2$, bal. Non-flammable) | 43.903 | 12.451 | 0.000 | 19.0 |
| 4 | Synthesis gas (20% CO, 4% $CH_4$, 3% $H_2$, 73% non-flammable) | 55.749 | 12.920 | 0.000 | 47.6 |

A particularly preferred example of the present invention that can provide significantly reduced emissions and reduced costs is the use of synthesis gas to replace methane as flare enrichment fuel. Synthesis gas is produced by the partial oxidation of methane in air:

$$2CH_4+O_2 \rightarrow 2CO+4H_2$$

The synthesis gas composition of Case 4 in the Table above may be produced by any means known to those skilled in the art. See, for example, "Effect of Pressure on Three Catalytic Partial Oxidation Reactions at Millisecond Contact Times," in *Catalysis Letters* volume 33 (1995), pages 15–29, written by A. G. Dietz III and L. D. Schmidt (hereinafter the "Dietz method"). Another example of a commonly known process to produce synthesis gas is through coal gasification.

Significantly less methane is required to generate a quantity of synthesis gas sufficient to sustain combustion and achieve a 98% destruction efficiency than would be required to fuel the flare directly. For example, the 47.6 MSCFH of synthesis gas required to fuel the flare in Case 4 above can be generated by the Dietz method from only 10.1 MSCFH of natural gas.

As the Table illustrates, the substitution of synthesis gas for methane as the flare enrichment fuel also affords reductions in carbon oxide and $NO_x$ emissions as well as fuel consumption. This is a highly desirable outcome of most industrial manufacturing facilities.

It will be apparent to one of ordinary skill in the art that many changes or modifications may be made to the invention described above without departing from the spirit or scope of the appended claims.

What is claimed is:

1. A method for improving the efficiency of a process which comprises a process stream at least a portion of which is capable of forming a gaseous hydrogen-containing enrichment stream, and a dilute gaseous waste material stream not capable of self-sustaining combustion, comprising gaseous waste material at least a portion of which is converted to carbon dioxide and water vapor by burning using a flare apparatus, said method comprising the steps of:

a) forming a gaseous hydrogen-containing enrichment stream derived from at least a portion of the process stream;

b) blending the gaseous hydrogen-containing enrichment stream with the dilute gaseous waste material stream to form a blended flare feed stream;

c) feeding the blended flare feed stream to the flare apparatus; and d) burning the blended flare feed stream using the flare apparatus to convert at least 80% of the gaseous waste material to carbon dioxide and water.

2. The method according to claim 1, wherein the gaseous hydrogen-containing enrichment stream comprises at least 4 mol % hydrogen, based upon the total moles of the gaseous hydrogen-containing enrichment stream.

3. The method according to claim 1, wherein the blended flare feed stream comprises at least 3 mol % hydrogen, based on the total moles of the blended flare feed stream.

4. The method according to claim 1, wherein the blended flare feed stream is capable of self-sustaining combustion in the flare apparatus.

5. The process according to claim 1, wherein the gaseous hydrogen-containing enrichment stream comprises hydrogen derived from ammonia dissociation.

6. The process according to claim 1, wherein the gaseous hydrogen-containing enrichment stream comprises hydrogen derived from synthesis gas.

7. The process according to claim 1, wherein the gaseous hydrogen-containing enrichment stream comprises hydrogen derived from acetylene tail gas.

8. The process according to claim 1, wherein the gaseous hydrogen-containing enrichment stream comprises hydrogen derived from hydrogen cyanide absorber off-gas.

9. The process according to claim 1, wherein said blending step comprises blending the dilute gaseous waste material stream with the gaseous hydrogen-containing enrichment stream and a gaseous hydrocarbon-containing enrichment fuel stream.

10. The process according to claim 1, wherein the process comprises a plurality of processes, each of which is capable of producing at least one product and of operating independently of other chemical processes.

* * * * *